US006677038B1

(12) United States Patent
Topolkaraev et al.

(10) Patent No.: US 6,677,038 B1
(45) Date of Patent: Jan. 13, 2004

(54) 3-DIMENSIONAL FIBER AND A WEB MADE THEREFROM

(75) Inventors: Vasily Aramovich Topolkaraev, Appleton, WI (US); Bernhardt Edward Kressner, Appleton, WI (US); Gregory James Wideman, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/232,033

(22) Filed: Aug. 30, 2002

(51) Int. Cl.[7] ..... D01F 8/00
(52) U.S. Cl. ..... 428/370; 428/373; 428/374
(58) Field of Search ..... 428/370, 373, 428/374

(56) References Cited

U.S. PATENT DOCUMENTS

| | | | | |
|---|---|---|---|---|
| 3,338,992 | A | 8/1967 | Kinney | |
| 3,341,394 | A | 9/1967 | Kinney | |
| 3,502,538 | A | 3/1970 | Petersen | |
| 3,502,763 | A | 3/1970 | Hartmann | |
| 3,542,615 | A | 11/1970 | Dobo et al. | |
| 3,692,618 | A | 9/1972 | Dorschner et al. | |
| 3,802,817 | A | 4/1974 | Matsuki et al. | |
| 3,849,241 | A | 11/1974 | Butin et al. | |
| 3,855,046 | A | 12/1974 | Hansen et al. | |
| 3,988,883 | A | 11/1976 | Sze | |
| 4,101,525 | A | 7/1978 | Davis et al. | 528/309 |
| 4,106,313 | A | 8/1978 | Boe | |
| 4,301,102 | A | 11/1981 | Fernstrom et al. | |
| 4,340,563 | A | 7/1982 | Appel et al. | |
| 4,348,517 | A | 9/1982 | Chakravarti | 523/425 |
| 4,355,132 | A | 10/1982 | East et al. | 524/602 |
| 4,374,175 | A | 2/1983 | Tanaka | |
| 4,405,686 | A | 9/1983 | Kuroda et al. | |
| 4,414,169 | A | 11/1983 | McClary | 264/210.7 |
| 4,424,257 | A | 1/1984 | Bach | |
| 4,462,855 | A | 7/1984 | Yankowsky et al. | 156/307.3 |
| 4,475,330 | A | 10/1984 | Kimura et al. | 57/245 |
| 4,521,484 | A | 6/1985 | Li | |

(List continued on next page.)

FOREIGN PATENT DOCUMENTS

| | | |
|---|---|---|
| WO | WO 97/49848 A1 | 12/1997 |
| WO | WO 00/28123 A1 | 5/2000 |

OTHER PUBLICATIONS

"Fibers," Cargill Dow, Internet web page, "http://www.cargilldow.com/fibers.asp", viewed and printd Jul. 23, 2002, pp. 1–4.

"Olefin Polymers," *Kirk–Othmer Encyclopedia of Chemical Technology*, Fourth Edition, vol. 17, 1996, pp. 765–767.

"PLA Processing Guide for Bulked Continuous Filament (BCF)," Cargill Dow, Internet web page, "http://www.cargilldow.com/pdf/fiberguide.html", viewed and printed Jul. 23, 2002, pp. 1–3.

Lunt, James and Andrew L. Shafer, "Polylactic Acid Polymers from Corn Potential Applications in the Textiles Industry," *Journal of Industrial Textiles*, vol. 29, No. 3, Jan. 2000, pp. 191–205 (reprint pp. 1–8).

*Primary Examiner*—N. Edwards
(74) *Attorney, Agent, or Firm*—Thomas J. Connelly

(57) ABSTRACT

A 3-dimensional fiber is disclosed that is constructed from first and second components. The first component is capable of being stretched and has a recovery percentage $R_1$. The second component is also capable of being stretched and has a recovery percentage $R_2$, wherein $R_1$ is higher than $R_2$. The first and second components are combined to form a linear fiber having an initial length that can be stretched at least 50%. The stretched fiber has the ability to retract to a length of from about 5% to about 90% of the stretched length to form a 3-dimensional fiber that exhibits elongation properties of at least 250% in at least one direction from the retracted length before the fiber becomes linear. A web formed from a plurality of 3-dimensional fibers is also disclosed.

25 Claims, 3 Drawing Sheets

U.S. PATENT DOCUMENTS 4,557,967 A 12/1985 Willemson et al. ..... 428/224
4,795,668 A 1/1989 Krueger et al.
4,851,172 A 7/1989 Rowan et al. ..... 264/130
4,861,660 A 8/1989 Ishii
4,867,936 A 9/1989 Buyalos et al. ..... 264/210.6
4,929,760 A 5/1990 Kitazume et al. ..... 568/308
4,975,326 A 12/1990 Buyalos et al. ..... 428/373
5,064,802 A 11/1991 Stevens et al.
5,067,538 A 11/1991 Nelson et al. ..... 152/451
5,085,818 A 2/1992 Hamlyn et al. ..... 264/210.6
5,108,820 A 4/1992 Kaneko et al.
5,132,067 A 7/1992 Nelson et al. ..... 264/210.8
5,234,764 A 8/1993 Nelson et al. ..... 428/364
5,238,740 A 8/1993 Simons et al. ..... 428/364
5,256,417 A 10/1993 Koltisko
5,285,623 A 2/1994 Baillievier et al. ..... 57/236
5,336,552 A 8/1994 Strack et al.
5,352,518 A 10/1994 Muramoto et al.
5,374,696 A 12/1994 Rosen et al.
5,376,430 A 12/1994 Swenson et al.
5,382,400 A 1/1995 Pike et al.
5,397,527 A 3/1995 Rim et al. ..... 264/210.8
5,411,636 A 5/1995 Hermans et al.
5,418,045 A 5/1995 Pike et al.
5,425,987 A 6/1995 Shawver et al.
5,429,856 A 7/1995 Krueger et al.
5,451,450 A 9/1995 Erderly et al.
5,472,775 A 12/1995 Obijeski et al.
5,492,598 A 2/1996 Hermans et al.
5,501,679 A 3/1996 Krueger et al.
5,539,124 A 7/1996 Etherton et al.
5,540,992 A 7/1996 Marcher et al.
5,547,755 A 8/1996 Reinthaler et al. ..... 428/364
5,554,775 A 9/1996 Krishnamurti et al.
5,599,420 A 2/1997 Yeo et al.
5,604,036 A 2/1997 Price et al.
5,630,976 A 5/1997 Nelson et al. ..... 264/210.8
5,707,468 A 1/1998 Arnold et al.
5,723,546 A 3/1998 Sustic
5,743,999 A 4/1998 Kamps et al.
5,763,334 A 6/1998 Gupta et al.
5,853,635 A 12/1998 Morell et al.
5,910,136 A 6/1999 Hetzler et al.
5,972,502 A 10/1999 Jessee et al.
6,054,002 A 4/2000 Griesbach, III et al.
RE36,698 E 5/2000 Kim et al. ..... 428/364
6,169,045 B1 1/2001 Pike et al.
6,172,177 B1 1/2001 Wang et al.
6,225,243 B1 5/2001 Austin

3-DIMENSIONAL FIBER AND A WEB MADE THEREFROM

BACKGROUND OF THE INVENTION

There are numerous methods known to those skilled in the art for spinning fibers that can be later formed into a nonwoven web. Many such nonwoven webs are useful in disposable absorbent articles for absorbing body fluids and/or excrement, such as urine, fecal matter, menses, blood, perspiration, etc. Three dimensional fibers are also useful in forming materials that can be stretched in the machine direction, cross direction or in both directions to form webs that can be made into bodyside covers, facings and liners. Manufacturers of such articles are always looking for new materials and ways to construct or use such new materials in their articles to make them more functional for the application they are designed to accomplish. The creation of a web of 3-dimensional, bicomponent fibers wherein the fibers are formed from at least one elastomeric material that can extend in at least one direction can be very beneficial. For example, an infant diaper containing an absorbent layer formed from cellulose pulp fibers interspersed into a web of 3-dimensional nonwoven fibers will allow the absorbent layer to retain a larger quantity of body fluid if the 3-dimensional fibers can extend. Such an absorbent layer can provide better leakage protection for the wearer and may not have to be changed as often. In another example, a spunbond nonwoven facing or liner formed from a plurality of 3-dimensional fibers can provide improved stretch and controllable retraction. Such facings or liners can provide improved fit and better comfort for the wearer of absorbent articles.

A web formed from such 3-dimensional fibers can provide one or more of the following attributes: improved fit, improved loft, better comfort, greater void volume, softer feel, improved resiliency, better stretch and controlled retraction.

The exact method utilized in forming a nonwoven web can create unique properties and characteristics in the web. Now a 3-dimensional fiber has been invented that exhibits exceptional elongation properties in at least one direction. A web made from such fibers has also been invented.

SUMMARY OF THE INVENTION

Briefly, this invention relates to a 3-dimensional fiber that exhibits exceptional elongation properties in at least one direction. The 3-dimensional fiber is formed from a first component and a second component. For example, the first component can form the core of the fiber and the second component can form a sheath around the core. The first component is capable of being stretched and has a recovery percentage $R_1$. The second component is also capable of being stretched and has a recovery percentage $R_2$, wherein $R_1$ is higher than $R_2$. The first and second components cooperate to form a linear fiber having an initial length that can be stretched at least 50%. The stretched fiber is then allowed to retract to a length of from about 5% to about 90% of its stretched length into a 3-dimensional fiber. The retracted 3-dimensional fiber exhibits the ability to be elongated at least 250% in at least one direction before the fiber becomes linear. A web made from such fibers has also been invented.

DETAILED DESCRIPTION OF THE INVENTION

Figure 1:
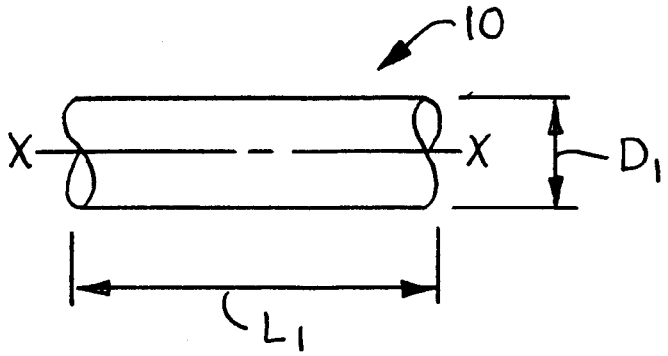
FIG. 1 is a plane view of a linear fiber of this invention.

Referring to FIG. 1, a linear fiber 10 is shown having an initial length $L_1$, an initial diameter $D_1$ and a longitudinal axis x—x. By "a linear fiber" it is meant that the fiber resembles a substantial straight line extending over its entire length. The term "fiber" is used to reference a material form having a length to diameter ratio of at least about 10:1. The linear fiber 10 is shown having a circular cross-sectional configuration. However, the cross-sectional configuration of the linear fiber 10 can vary and may include a bilobal configuration, a trilobal configuration, a square, a rectangle, an oval, or any other geometrical shape known to those skilled in the fiber art. The linear fiber 10 can be formed on a commercial spinning or drawing process such that it is produced as a continuous length fiber having an essentially constant diameter. The continuous fiber can then be cut into various useable lengths. For application of the linear fibers 10 in a disposable absorbent article such as a diaper, a training pant, a sanitary napkin, a pantyliner, a tampon, an adult incontinence brief, an undergarment or an incontinence pad, the linear fibers 10 can have an initial diameter $D_1$ of from about 15 microns to about 100 microns. Desirably, the initial diameter $D_1$ of the linear fiber 10 will be from about 15 microns to about 50 microns. The continuous linear fiber 10 can be cut to an initial length $L_1$ of from about 1 millimeter to about 500 millimeters. Desirably, the continuous linear fibers 10 are cut to an initial length $L_1$ of from about 5 millimeters to about 100 millimeters. Most desirably, the continuous linear fibers 10 are cut to an initial length $L_1$ of less than about 50 millimeters.

Figure 2:
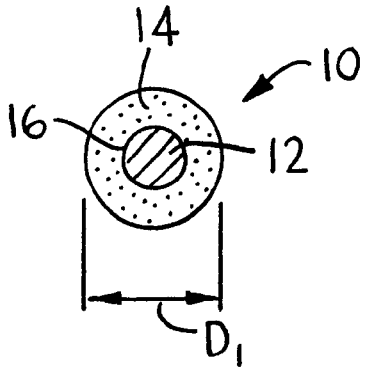
FIG. 2 is a cross-sectional view of a fiber constructed of first and second components configured in a coaxially aligned core-sheath arrangement.

Referring to FIGS. 2–7, various cross-sectional configurations are shown for constructing the linear fiber 10. These depictions are only representations of some of the vast array of geometrical arrangements and shapes that can be utilized to construct the linear fiber 10. Desirably, the linear fiber 10 has a circular cross-sectional configuration. In FIG. 2, the linear fiber 10 is shown constructed of a first component 12 and a second component 14. The first component 12 is coaxially aligned relative to the second component 14 and forms the inner core of the linear fiber 10. The first component 12 can be substantially concentrically arranged with the second component 14. By "concentrically arranged" is meant that the first and second components, 12 and 14 respectively, have the same center. By "substantially concentrically arranged" is meant that the centers can be slightly offset due to the manufacturing process by which such bicomponent fibers are formed. The first component 12 has a circumference 16 which is completely surrounded by the second component 14. In other words, the second component 14 forms a sheath around the outer circumference 16 of the first component 12 and the linear fiber has an initial diameter $D_1$. In this embodiment, the linear fiber 10 has a circular cross-sectional configuration and each of said first and second components, 12 and 14 respectively, form a portion of the cross-sectional configuration. This bicomponent configuration for the linear fiber 10 is well recognized by those skilled in the art. It should be noted that the overall shape, diameter and orientation of the first component 12 relative to the second component 14 can vary depending upon one's unique desires and application for the fiber.

Figure 3:
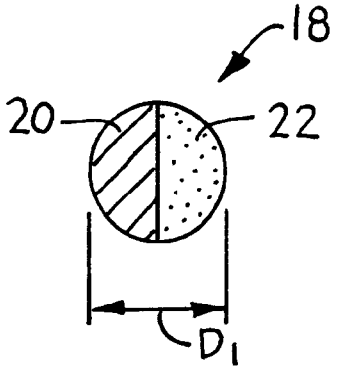
FIG. 3 is a cross-sectional view of a fiber constructed of first and second components configured in a side by side arrangement.

In FIG. 3, a linear fiber 18 is depicted constructed of a first component 20 and a second component 22 arranged in a side by side configuration. Both the first and second components 20 and 22 are of the same size and have a semi-circular configuration. The first and second semi-circular components 20 and 22 are joined together to form a circle having an initial diameter $D_1$.

Figure 4:
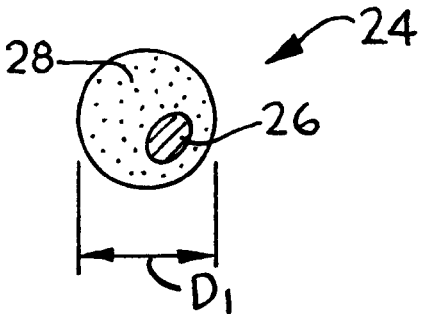
FIG. 4 is a cross-sectional view of a fiber constructed of first and second components configured such that the first component is non-circular and aligned off center while being entrapped by said second component.

In FIG. 4, a linear fiber 24 is depicted constructed of first component 26 and a second component 28 arranged such that the first component 26 is completely enclosed by the second component 28. The first component 26 has a non-circular cross-section and is aligned off center from the second component 28. FIG. 4 represents a variation of the coaxially aligned first and second components 12 and 14, shown in FIG. 2. The second component 28 has an initial diameter $D_1$.

Figure 5:
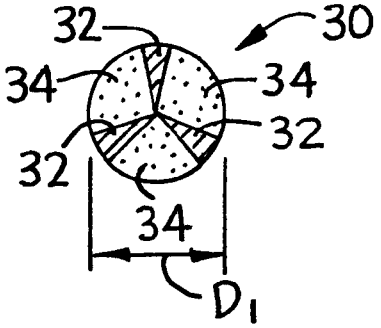
FIG. 5 is a cross-sectional view of a fiber constructed of first and second components configured such that said first and second components each includes three pie slices alternately aligned over 360 degrees.

In FIG. 5, another linear fiber 30 is depicted constructed of a first component 32 and a second component 34. The first and second components, 32 and 34 respectively, are pie shape in cross-sectional configuration and are alternately arranged to form a circle spanning an arc of 360 degrees. The first components 32 are shown being smaller in size than the second components 34, although they can be of an equal or larger size if desired. In this embodiment, there are three first components 32 and three second components 34. However, various numbers of first and second components 32 and 34 can be utilized. The first and second pie shaped components 32 and 34 are joined together to form a circle having an initial diameter $D_1$.

Figure 6:
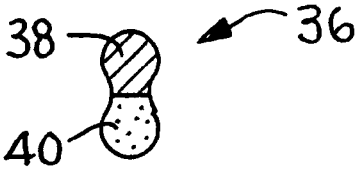
FIG. 6 is a cross-sectional view of a bilobal fiber constructed of first and second components.

In FIG. 6, still another linear fiber 36 is depicted constructed of a first component 38 and a second component 40. The linear fiber 36 has a bilobal configuration with one lobe formed from the first component 38 and the second lobe formed from the second component 40. The overall size and shape of the lobes can vary to suit one's particular needs. It is also possible to construct the linear fiber 36 such that one component represents more than 50% of the total cross-sectional area.

Figure 7:
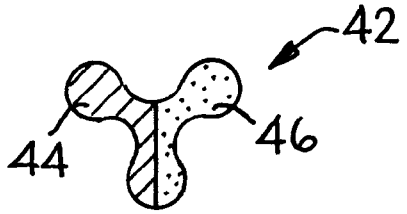
FIG. 7 is a cross-sectional view of a trilobal fiber constructed of first and second components.

In FIG. 7, still another alternative embodiment of a linear fiber 42 is depicted constructed of a first component 44 and a second component 46. The linear fiber 42 has a trilobal configuration with one and a half lobes formed from the first component 44 and the remaining one and a half lobes being formed from the second component 46. The overall size and shape of the lobes can vary to suit one's particular needs. As was stated above with reference to the bilobal design, the linear fiber 42 can be constructed such that one component represents more than 50% of the total cross-sectional area.

It should be mentioned that in any of the cross-sectional views shown in FIGS. 2–7, the first component(s) is adhered to, bonded or joined to the second component(s). This can be accomplished by various methods known to those skilled in the art, for example, by an adhesive. It is important to note that the first and second components have a strong mutual adhesion for each other. The first component can be adhered to the second component by physical, chemical and/or mechanical methods. Physical methods include thermal bonding. An example of physically adhering or joining the first component to the second component is by surface tension or by partial mixing between the two materials from which the first and second components are constructed. Alternatively, the first component(s) can be chemically bonded to the second component(s) by the interaction of chemical bonds. Thirdly, the first component(s) can be mechanically joined to the second component(s) by an adhesive, a glue or by mechanical interlocking.

Figure 8:
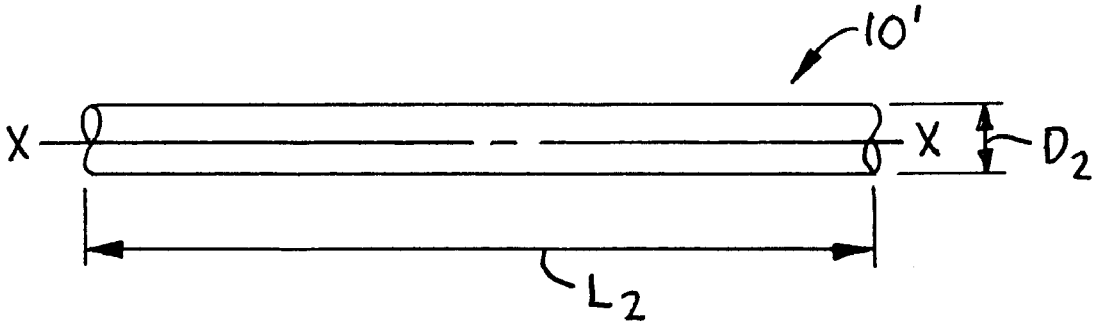
FIG. 8 is the linear fiber shown in FIG. 1 after being stretched at least 50%.

Referring now to FIG. 8, the linear fiber 10 is capable of being stretched lengthwise along it longitudinal axis x—x to form a stretched fiber 10' having a length $L_2$. The linear fiber 10 can be stretched at least about 50% of its initial length $L_1$ to form a stretched fiber 10'. By stretching the linear fiber 10 to at least about 50% of its initial length $L_1$ means that the length $L_2$ of the stretched fiber 10' will be at least about 1.5 times the initial length $L_1$. Desirably, the linear fiber 10 is capable of being stretched anywhere from between about 50% to over 1,000% of its initial length $L_1$ to a stretched length $L_2$. Most desirably, the linear fiber 10 is capable of being stretched up to several hundred percent of its initial length $L_1$ to a stretched length $L_2$. In one application, the linear fiber 10 can be stretched up to a length of about 500% of its initial length $L_1$. In a second application, the linear fiber can be stretched up to about 700% of its initial length $L_1$. In a third application, the linear fiber 10 can be stretched up to about 900% of its initial length $L_1$.

As the linear fiber 10 is stretched, its diameter $D_1$ will be reduced to a smaller diameter $D_2$. The new diameter $D_2$ of the stretched fiber 10' will be dependent upon the amount that the linear fiber 10 is stretched. For example, the greater the amount the linear fiber 10 is stretched, the smaller the resulting stretched diameter $D_2$ will be. The stretched fiber 10' will have a diameter $D_2$ that will be from about 25% to about 95% of the initial diameter $D_1$. Desirably, the stretched fiber 10' will have a diameter $D_2$ that will be from about 25% to about 80% of the initial diameter $D_1$. Most desirably, the stretched fiber 10' will have a diameter $D_2$ that will be from about 50% to about 70% of the initial diameter $D_1$.

Referring again to FIGS. 1 and 2, the invention will be explained from here on referring to the first component 12 and the second component 14, simply because it will be easier than referring to all the other first and second components shown in FIGS. 3–7. However, it should be kept in mind that the first and second components 20 and 22, 26 and 28, 32 and 34, 38 and 40, and 44 and 46 respectively, will have the same characteristics and properties as the first and second components, 12 and 14 respectively.

The first component 12 and the second component 14 are both capable of being stretched or drawn in a solid state. By stretching or drawing is meant to lengthen by pulling. It has been found empirically that the first and second components, 12 and 14 respectively, can be jointly stretched without debonding or separating at the interfaces. Debonding or separating is undesirable because it could result in split fibers. Each of the first and second components, 12 and 14 respectively, is formed from a material that is capable of being stretched to a longer length than its initial length. Desirably, each of the first and second components, 12 and 14 respectively, can be stretched from at least about 50% to about 1,000% or more of its initial length. Desirably, each of the first and second components, 12 and 14 respectively, can be stretched from at least about 50% to about 700% of its initial length. Most desirably, each of the first and second components, 12 and 14 respectively, can be stretched from at least about 50% to about 200% of its initial length.

Stretching the first and second components, 12 and 14 respectively, below the lower limit of at least about 50% can result in flat, mainly two-dimensional fibers of curly nature, without a formation of a distinctive 3-dimensional fiber with a helical-coil structure. Stretching above the upper limit of about 1,000% can result in fibers that split or breakup. However, in some cases higher stretch limits are attainable.

The stretching or drawing of the linear fiber 10 occurs when the linear fiber 10 is solidified, i.e. in a solid state, and at a temperature that will yield a good drawing regime. Stretching of the linear fiber 10 can be accomplished at an elevated temperature, for example, above the glass transition temperature of the first and second components, 12 and 14 respectively. However, the stretching should occur at a temperature that is below the melting temperature of the first and second components, 12 and 14 respectively. If stretched below the glass transition temperature of the first component 12, a sufficient retraction is not achieved. If stretched above the melting temperature of one of the first or the second components, 12 or 14 respectively, the retraction property is lost. If stretched above the melting temperature of the first component 12, the fibers may lose integrity. If stretched above the melting temperature of the second component 14, plastic yielding and drawing of second component 14 is not accomplished.

As noted above, the first component 12 and the second component 14 cooperate to form the linear fiber 10. In forming the linear fiber 10, at least a portion of the first component 12 will be in direct contact with at least a portion of the second component 14. In addition to the stretchable characteristic, the first and second components, 12 and 14, respectively, also have a recovery characteristic expressed as "recovery percentage". Both of the first and second components, 12 and 14 respectively, must be capable of retracting or contracting from a stretched condition in order for the linear fiber 10 to be useful in an absorbent structure. As referred to herein, the term "retracting" means the same thing as "contracting". The recovery percentage for the first component 12 is $R_1$. The recovery percentage for the second component 14 is $R_2$. The recovery percentage is defined as the percent the particular component can recover after it has been stretch to at least about 50% of its initial length and upon removal of the force that was applied to stretch it.

It should be noted that the recovery percentage $R_1$ for the first component 12 is higher than the recovery percentage $R_2$ of the second component 14. The ratio $R_1/R_2$ is at least about 2. Desirably, the ratio $R_1/R_2$ ranges from at least about 2 to about 100. Most desirably, the ratio $R_1/R_2$ ranges from at least about 2 to about 50. The reason for making $R_1$ greater than $R_2$ is that upon retraction or contraction of the first and second components, 12 and 14 respectively, a very desirable, predetermined structural configuration can be obtained. The structural configuration of the retracted fiber will exhibit exceptional elongation properties in at least one direction.

The linear fiber 10 further obtains some of its unique properties when the first component 12 makes up a volume percent of from about 30% to about 95% of the linear fiber 10 and the second component makes up a volume percent of from about 5% to about 70% of the linear fiber 10. Desirably, the first component 12 makes up a volume percent from about 40% to about 80% of the linear fiber 10 and the second component 14 makes up a volume percent of from about 20% to about 60% of the linear fiber 10. The volume of a solid linear fiber 10 is calculated using the following formula:

$$V=\pi(d^2/4)L_1$$

where: V is the volume of the solid linear fiber;

- $\pi$ is a transcendental number, approximately 3.14159, representing the ratio of the circumference to the diameter of a circle and appearing as a constant in a wide range of mathematical problems;
- d is the diameter of the linear fiber; and
- $L_1$ is the initial length of the linear fiber.

The above described ranges of volume percents for the first component 12 and for the second component 14 allows the linear fiber 10 to be stretched at least 50% to form a stretched linear fiber 10'. The volume percent of each of the first and second components, 12 and 14 respectively, also plays a vital role in the retraction or contraction of the stretched fiber 10' to a retracted length $L_3$. By varying the volume percent of each of the first and second components, 12 and 14 respectively, one can manufacture a linear fiber 10 that can be stretched and then retracted to a predetermined configuration and with certain desirable characteristics. At a later time, after such fibers are formed into a disposable absorbent article, the contact with a body fluid will cause the absorbent article to swell which will allow the fibers to elongate in at least one direction before the fiber becomes linear. As the fibers elongate, they can expand and allow the absorbent structure to receive and store additional body fluids.

Figure 9:
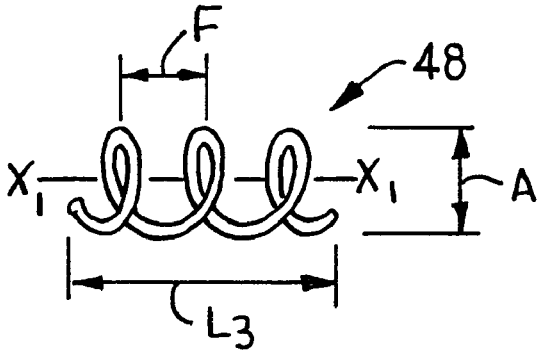
FIG. 9 is a helical fiber formed by retracting the stretched fiber shown in FIG. 8.

Referring to FIGS. 8 and 9, the stretched fiber 10' possesses the unique ability of being capable of retracting from its stretched length $L_2$ down to a shorter length $L_3$. It has been found empirically that the first and second components, 12 and 14 respectively, can be jointly retracted without debonding or separating at the interfaces. Debonding or separating is undesirable because it could result in split fibers. The stretched fiber 10' has the ability to retract to a length $L_3$ that can range from about 5% to about 90% of the stretched length $L_2$. The retracted length $L_3$ can be shorter, equal to or longer than the initial length $L_1$ of the linear fiber 10. The final retracted length $L_3$ of the stretched fiber 10' will depend on a variety of factors including the materials from which the linear fiber 10 is constructed, the configuration and makeup of the first and second components, 12 and 14 respectively, as well as the amount the linear fiber 10 was stretched. Generally, the greater amount the linear fiber 10 is stretched, the greater will be its amount of retraction. In some applications, it is desirable to have the stretched fiber 10' retract to a length $L_3$ that is shorter than the initial length $L_1$ of the linear fiber 10. In other cases, it is advantageous to have the stretched fiber 10' retract to a length $L_3$ that is equal to or greater than the initial length $L_1$ of the linear fiber 10.

The retraction ability of the stretched fiber 10' is an important aspect of this invention.

The following formula shows how to calculate the retracted length $L_3$ of the stretched fiber 10':

$$L_2=L_1+(L_1\times\text{stretched\% } 100)$$

$$L_3=L_2\times R_3/100$$

where:

$L_1$ is the initial length of the linear fiber;

$L_2$ is the stretched length of the linear fiber;

$L_3$ is the retracted length of the stretched fiber; and $R_3$ is the retraction percentage of the 3-dimensional fiber.

The first and second components, 12 and 14 respectively, are chemically, mechanically and/or physically adhered or joined to one another to prevent the fiber from splitting when the fiber is stretched and then allowed to relax. The relaxed fiber will retract in length. Desirably, the first component 12 will be strongly adhered to the second component 14. In the core/sheath arrangement, the mechanical adhesion between the first and second components, 12 and 14 respectively, will compliment any chemical and/or physical adhesion that is present and aid in preventing splitting or separation of the first component 12 from the second component 14. This splitting or separation occurs because one component is capable of retracting to a greater extent than the other component. If a strong mutual adhesion is not present, especially during retraction, the two components can split apart and this is not desirable. In a fiber formed of two components arranged in a side by side or wedge shape configuration, a strong chemical and/or physical adhesion will prevent the first component 12 from splitting or separating from the second component 14.

Referring now to FIG. 9, a 3-dimensional fiber 48 is depicted in the shape of a helix or helical coil that has a longitudinal central axis $x_1$—$x_1$. By "3-dimensional fiber" is meant that the fiber has an x, y and z component that is formed by virtue of coils and/or curves regularly or irregularly spaced and whose extremities in the x, y and z planes form a locus of points which define a volume greater than a linear fiber. In a desired case, a 3-dimensional fiber forms a coil that circumscribes 360 degrees. The helical coil can be continuous or non-continuous over the entire length of the fiber. Most desirably, the 3-dimensional fiber 48 is a continuous helical coil. A 3-dimensional fiber differs from a 2-dimensional fiber in that the 2-dimensional fiber has only two components, for example an x and y component; an x and z component, or a y and z component. Many crimp fibers are 2-dimensional fibers that are flat and extend in only two directions. A crimped fiber is typically a fiber that has been pressed or pinched into small, regular folds or ridges. A crimped fiber usually has a bend along its length.

The 3-dimensional fiber 48 has a non-linear configuration when it forms a helical coil. Desirably, the 3-dimensional fiber 48 has a helical configuration that extends along at least a portion of its length $L_3$. Most desirably, the helical configuration extends along a substantial portion of or along the entire length $L_3$ of the fiber. The 3-dimensional fiber 48 also has an amplitude "A" that is measured perpendicular to its retracted length $L_3$. The amplitude "A" of the 3-dimensional fiber 48 can range from about 10 microns to about 5,000 microns. Desirably, the amplitude "A" of the 3-dimensional fiber 48 ranges from about 30 microns to about 1,000 microns. Most desirably, the amplitude "A" of the 3-dimensional fiber 48 ranges from about 50 microns to about 500 microns. The 3-dimensional fiber 48 further has a frequency "F" measured at two locations separated by 360 degrees between adjacent helical coils. The frequency "F" is used to denote the number of coils or curls formed in each inch of the coiled fiber length. The frequency "F" can range from about 10 to about 1,000 coils per inch. Desirably, the frequency "F" can range from about 50 to about 500 coils per inch. It should be noted that the amplitude "A" and/or the frequency "F" can vary or remain constant along at least a portion of or over the entire retracted length $L_3$ of the 3-dimensional fiber 48. Desirably, the amplitude "A" and the frequency "F" will remain constant over a majority of the retracted length $L_3$. The amplitude "A" of the retracted 3-dimensional fiber 48 and the frequency "F" of the helical coils forming the 3-dimensional fiber 48 affect the overall reduction in length $L_3$ of the 3-dimensional fiber 48.

It should be noted that the deformation properties of the first and second components, 12 and 14 respectively, will affect the configuration and size of the helical coils developed as the stretched fiber 10' retracts into the 3-dimensional fiber 48.

The first component 12 in the linear fiber 10 has an elongation of at least about 50% deformation. The first component 12 is able to recover at least about 20% of the stretch deformation, based on the length after deformation, desirably, about 50% of the stretch deformation with a set deformation of about 20% or less. The set deformation is unrecoverable deformation after stretching based on the initial length $L_1$ of the first component 12. If the first component 12 has an elongation below at least about 50% or a recovery of less than about 20%, the recovery or relaxation power is not sufficient to activate helical coiling of the retracted fiber 48. Repetitive helical coils in the retracted fiber 48 is most desirable. A higher elongation than at least about 50% for the first component 12 is desirable. For example, an elongation of at least about 100% is good, an elongation exceeding 300% is better, and an elongation exceeding 400% is even better.

The second component 14 in the linear fiber 10 has a total deformation which includes a permanent unrecoverable deformation value and a recoverable deformation value. The permanent unrecoverable deformation value in a solid state, as a result of stretching, plastic yielding and/or drawing, is at least about 40%. The recoverable deformation value is at least about 0.1%. A higher elongation than at least about 50% for the second component 14 is desirable. An elongation of at least about 100% is good, and an elongation exceeding about 300% is even better. The plastic yielding results in thinning of a second component 14. The second component 14 has a deformation which can range from about 50% to about 700% or more when the linear fiber 10 is stretched in a solid state. Stretching in a solid state means that the second component 14 is stretched below its melting temperature. If the total deformation of the second component 14 is below at least about 50%, the second component 14 will fail and break during the stretching process. Also, at low deformation, the second component 14 does not provide a sufficient level of a permanent plastic yielding and thinning which is desired for the formation of the repetitive helical coils in the retracted 3-dimensional fiber 48. Stretching should not occur at very low temperatures because the fibers may be brittle and could break. Likewise, the fibers should not be stretched very quickly because this might cause the fibers to break before reaching the desired percent of elongation.

The percent elongation of the length $L_3$ of the 3-dimensional retracted fiber 48 is defined as the percent change in length by which the helical coiled fiber 48 can be stretched before becoming straight or linear. The percent elongation can be expressed by the following formula:

$$\%E=100\times(L_4-L_3)/L_3$$

where:

%E is the percent elongation of the retracted 3-dimensional fiber 48;

$L_3$ is the retracted length of the 3-dimensional fiber 48; and $L_4$ is the final length of the retracted 3-dimensional fiber 48 once it is stretched into a straight or uncoiled configuration.

The retracted 3-dimensional fiber 48 has the ability to be subsequently elongated to at least 100% of its retracted length $L_3$. Most desirably, the retracted 3-dimensional fiber 48 can be subsequently elongated from about 150% to about 900% of its retracted length $L_3$. Even more desirably, the retracted 3-dimensional fiber 48 can be subsequently elongated from about 250% to about 500% of its retracted length $L_3$. Still more desirably, the retracted 3-dimensional fiber 48 can be subsequently elongated from about 300% to about 400% of its retracted length $L_3$.

The 3-dimensional fiber 48 exhibits exceptional elongation properties in at least one direction before the fiber becomes linear. Elongation is defined as the percent length by which the 3-dimensional fiber 48 can be stretched before it becomes straight or linear. The direction of the elongation property of the 3-dimensional fiber 48 is normally in the same direction as the linear fiber 10 was stretched. In other words, the direction that the retracted fiber 48 is able to subsequently elongate will be opposite to the direction of its retraction. It is possible for the retracted fiber 48 to have elongation properties in two or more directions. For example, the retracted fiber 48 can subsequently be elongated in both the x and y directions.

The 3-dimensional fiber 48 is obtained once the stretched fiber 10' is allowed to retract. The 3-dimensional fiber 48 is able to acquire its helical profile by the difference in recovery percentage of the first component 12 compared to the second component 14. For example, since the first component 12 has a higher recovery percentage $R_1$ than the second component 14, it will want to retract to a greater degree than the second component 14. However, both the first component 12 and the second component 14 will retract or contract the same amount since they are physically, chemically or mechanically adhered or joined to one another. The combination of the volume percent, explained above, and the recovery percent of the first and second components, 12 and 14 respectively, creates the unique 3-dimensional configuration of the fiber 48. The retraction or recovery of the first and second components, 12 and 14 respectively, establishes the twist or coiling effect in the retracted fiber 48. The amount of coiling obtained, as well as the location of the coiling, can be controlled by the selection of materials that are used to construct the linear fiber 10. These two variables, the amount of coiling and the location of the coiling, can also be controlled by the volume of each component, as well as the amount the linear fiber 10 is stretched. The time and temperature conditions under which the stretched fiber 10' is stretched and allowed to retract can also affect the finish profile of the retracted fiber 48.

The first component 12 has a higher recovery percentage $R_1$ than the second component 14 and therefore the material from which it is formed tends to be more tacky and elastic. For this reason, the material with the higher recovery percentage $R_1$ is used to form the inner core while the material having a lower recovery percentage $R_2$ tends to be used to form the outer sheath. As the first and second components, 12 and 14 respectively, try to retract from the stretched condition; the outer sheath will retract or contract less. This means that the first component 12 will not be able to retract fully to an amount that it could if it was by itself. This pent up force creates the twist or helical coil effect in the retracted fiber 48. By varying the materials used to form the linear fiber 10 and by controlling the conditions to which the linear fiber 10 is stretched and then retracted, one can manufacture uniquely configured fibers that will subsequently elongate in a predetermined way that is advantageous for use in a disposable absorbent article or in some other type of article.

The following Table 1 shows the recovery percent of individual materials that have been stretched to varying percentages. The material forming each sample was cut out from a thin sheet of a particular thickness in the shape of a dogbone or dumbbell. The dogbone shaped sample had an initial length of 63 millimeters (mm) measured from a first enlarged end to a second enlarged end. In between the two oppositely aligned, enlarged ends was a narrow section having a length $l_1$ of 18 mm and a width of 3 mm. The material was then placed in a tensile tester and stretched at a rate of 5 inches per minute, in the machine direction of the material, a predetermined amount at a specific temperature. This caused the narrow section of the sample to elongate. The force used to stretch the sample was then removed and the sample was allowed to retract or recover. The length of the narrow section, known as the finished recovery length, was measured and recorded as a percentage of the stretched length. One can extrapolate from this information that when such a material is combined with another material to form a linear fiber 10, that similar ranges of recovery or contraction will be experienced.

TABLE 1

| Material | Thickness in mils | Stretch Temp. C° | 50% stretched & recovered | 100% stretched & recovered | 200% stretched & recovered | 700% stretched & recovered |
|---|---|---|---|---|---|---|
| Polyurethane | 5 | 25 | 24.5% | 39.1% | 54.4% | — |
| Polypropylene | 3 | 25 | 5.4% | 5.5% | 5.1% | — |
| Polypropylene | 3 | 75 | — | 8.7% | 7.3% | 6.4% |

Figures 10, 11, 12:
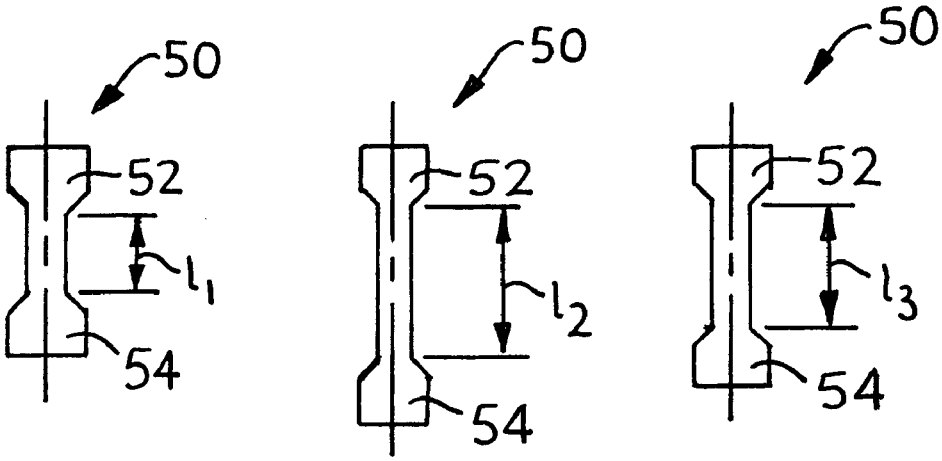
FIG. 10 is a plane view of a dogbone or dumbbell shaped sample having a narrow section located between two enlarged ends with the narrow section having an initial length $l_1$.
FIG. 11 is a plane view of the dogbone shaped sample shown in FIG. 10 after it has been stretched in the longitudinal direction such that the narrow section is elongated to a length $l_2$.
FIG. 12 is a plane view of the dogbone shaped sample shown in FIG. 11 after the force used to stretch it has been removed and the narrow section has retracted to a shorter length $l_3$, wherein $l_3$ is shorter than the elongated length $l_2$.

Referring to FIGS. 10–12, a dogbone shaped sample 50 is depicted before being stretched with a narrow section $l_1$ located between its first and second enlarged ends, 52 and 54 respectively. Each of the enlarged ends 52 and 54 of the dog bone sample 50 is secured in a tensile tester and a force is applied causing the material to be stretched, in the machine direction of the material, a predetermined amount at a specific temperature. By stretching the sample 50, the narrow section is stretched to a length $l_2$. The length $l_2$ is greater than the initial length $l_1$, see FIG. 11. The force exerted on the sample 50 is then removed and the sample 50 is allowed to retract such that the narrow section is shortened to a length $l_3$, see FIG. 12. The retracted length $l_3$ is smaller than the stretched length $l_2$ but is greater than the initial length $l_1$. The recovery percent (R %) of the different materials that can be used in forming the fiber can be calculated using the following formula:

$$\text{Recovery } \% = [(l_2 - l_3)/l_2] \times 100$$

where:

$l_2$ is the stretched length of the narrow section of the sample; and $l_3$ is the retracted length of the narrow section of the sample.

Returning to FIGS. 1, 8 and 9, the linear fiber 10 has been described as possessing unique properties and characteristics. The linear fiber 10 acquires some of these properties from the materials of which it is formed while other characteristics are due to the way the linear fiber 10 is constructed and how it is later stretched and allowed to retract. Desirably, the linear fiber 10 is a synthetic fiber. A synthetic fiber enables the retracted fiber 48 to exhibit a highly coiled elastic configuration with good elastic properties, good stretchable properties, and preferred interaction with body fluids, especially urine. This is especially beneficial when the linear fiber 10 is used in a disposable absorbent article. A synthetic fiber allows for adjacent helical coils in the retracted fiber 48 to be loosely or tightly formed, depending on one's particular needs. Tightly formed helical coils provide exceptional elongation properties which allow the retracted fiber 48 to be elongated to a greater extent when formed into an absorbent article which will swell when brought into contact with a body fluid. A tightly formed helical coil may also elongate at a quicker speed than a loosely compacted helical coil. A synthetic fiber can be biodegradable and environmentally friendly. Both of these characteristics are advantageous in manufacturing a disposable absorbent article that may eventually end up in a land fill.

The linear fiber 10 is constructed of the first and second components, 12 and 14 respectively. The first component 12 can be substituted for the second component 14 and vice versa but best results are obtained when the first component 12 is used as the inner or core material and the second component 14 is used as the outer or sheath material. The first component 12 has the higher recovery percentage $R_1$ and therefore is desirably an elastic material versus a material having a low elastic recovery. The first component 12 can be formed from an elastomeric. Suitable elastomeric materials include melt extrudable thermoplastic elastomers such as polyurethane elastomers, copolyether esters, polyamide polyether copolymers, ethylene vinyl acetate (EVA) elastomers, styrenic block copolymers, polyether block polyamide copolymers, and olefinic elastomers. Useful elastomeric resins include polyester polyurethane and polyether polyurethane. An example of such an elastomeric is sold under the trade designations PN 3429-219 and PS 370-200 MORTHANE® polyurethanes. MORTHANE® is a registered trademark of Huntsman Polyurethanes having an office in Chicago, Ill. 60606. Another suitable elastomeric material is ESTANE®, a registered trademark of Noveon, Inc. having an office in Cleveland, Ohio 44141. Still another suitable elastomeric material is PEARLTHANE®, a registered trademark of Merquinsa having an office in Boxford, Mass. 01921.

Three additional elastomeric materials include a polyether block polyamide copolymer which is commercially available in various grades under the trade designation PEBAX®, a registered trademark of Atofina Chemicals, Inc. having an office in Birdsboro, Pa. 19508; a copolyether-ester sold under the trade designation ARNITEL®, a registered trademark of DSM having an office at Het Overloon 1, NL-6411 TE Heerlen, Netherlands; and a copolyether-ester sold under the trade designation HYTREL®, a registered trademark of E.I. DuPont de Nemours having an office in Wilmington, Del. 19898.

The first component 12 can also be formed from a styrenic block copolymer such as KRATON®), a registered trademark of Krayton Polymers having an office in Houston, Tex.

The first component 12 can further be formed from a biodegradable elastomeric material such as polyester aliphatic polyurethanes or polyhydroxyalkanoates. The first component 12 can be formed from an olefinic elastomeric material, such as elastomers and plastomers. One such plastomer is an ethylene-based material sold under the trade designation AFFINITY®), a registered trademark of Dow Chemical Company having an office in Freeport, Tex. AFFINITY® resin is an elastomeric copolymer of ethylene and octene produced using Dow Chemical Company's INSITE™ constrained geometry catalyst technology. Another plastomer is sold under the trade designation EXACT® which includes single site catalyzed derived copolymers and terpolymers. EXACT® is a registered trademark of Exxon Mobil Corporation having an office at 5959 Las Colinas Boulevard, Irving, Tex. 75039-2298. Other suitable olefinic elastomers that can be used to form the first component 12 include polypropylene-derived elastomers.

The first component 12 can further be formed from a non-elastomeric thermoplastic material which has a sufficient recovery percentage $R_1$ after it has been stretched at a specified temperature. Non-elastomeric materials useful in forming the first component 12 are extrudable thermoplastic polymers such as polyamides, nylons, polyesters, polyolefins or blends of polyolefins. For example, non-elastomeric, biodegradable polylactic acid can provide a sufficient recovery percentage $R_1$ when stretched above its transition temperature of about 62° C.

Referring now to the second component 14, it too can be formed from various materials. The second component 14 can be formed from a polyolefin resin, such as a fiber grade polyethylene resin sold under the trade designation ASPUN® 6811A. ASPUN® is a registered trademark of Dow Chemical Company having an office in Midland, Mich. 48674. A second example of a polyolefin resin is a homopolymer polypropylene such as Himont PF 304, and PF 308, available from Basell North America, Inc. having an office at Three Little Falls Centre, 2801 Centerville Road, Wilmington, Del. 19808. A third example of a polyolefin resin is polypropylene PP 3445 available from Exxon Mobil Corporation having an office at 5959 Las Colinas Boulevard, Irving, Tex. 75039-2298. Still other suitable polyolefinic materials that can be used for the second component 14 include random copolymers, such as a random copolymer containing propylene and ethylene. One such random copolymer is sold under the trade designation Exxon 9355, available from Exxon Mobil Corporation having an office at 5959 Las Colinas Boulevard, Irving, Tex. 75039-2298.

The second component 14 can also be formed from a melt extrudable thermoplastic material that provides sufficient permanent deformation upon stretching. Such materials include, but are not limited to, aliphatic and aromatic polyesters, polyethers, polyolefins such as polypropylene or polyethylene or blends thereof and copolymers, polyamides and nylons. The second component 14 can further be formed from a biodegradable resin such as aliphatic polyesters. One such aliphatic polyester is polylactic acid (PLA). Other biodegradable resins include polycaprolactone, polybutylene succinate adipate and polybutylene succinate. Polybutylene succinate adipate and polybutylene succinate resins are sold under the trade designation BIONOLLE® which is a registered trademark of Showa High Polymers having a sales office in New York, N.Y. 10017. Additional biodegradable resins include copolyester resin sold under the trade designation EASTAR BIO™, a registered trademark of Eastman Chemical Company having an office in Kingsport, Tenn. 37662. Still other biodegradable resins include polyhydroxyalkanoates (PHA) of varying composition and structure, and copolymers, blends and mixtures of the foregoing polymers. Specific examples of suitable biodegradable polymer resins include BIONOLLE® 1003, 1020, 3020 and 3001 resins commercially available from Itochu International. BIONOLLE® is a registered trademark of Showa High Polymers having an office in New York, N.Y. 10017.

The second component 14 can also be formed from a water-soluble and swellable resin. Examples of such water-soluble and swellable resins include polyethylene oxide (PEO) and polyvinyl alcohol (PVOH). Grafted (gPEO) or chemically modified PEO can also be used. The water-soluble polymer can be blended with a biodegradable polymer to provide processablility, performance, and interactions with liquids.

It should be noted that the PEO resin can be chemically modified by reactive extrusion, grafting, block polymerization or branching to improve its processability. The PEO resin can be modified by reactive extrusion or grafting as described in U.S. Pat. No. 6,172,177 issued to Wang et al. on Jan. 9, 2001, and which is incorporated by reference and made a part hereof.

Lastly, the second component 14 has a lower recovery percentage $R_2$ than the first component 12. The second component 14 can be formed from a material that exhibits a low elastic recovery. Materials from which the second component 14 can be formed include, but are not limited to, polypropylene, polyethylene, polyolefin, polyethylene oxide (PEO), polyvinyl alcohol (PVOH), polyester and polyether. The second component 14 can be treated or modified with hydrophilic or hydrophobic surfactants. Treatment with a hydrophilic surfactant will form a wettable surface for increasing interaction with a body fluid or liquid. For example, when the surface of the second component 14 is treated to be hydrophilic, it will become more wettable when contacted by a body fluid, especially urine.

Figure 13:
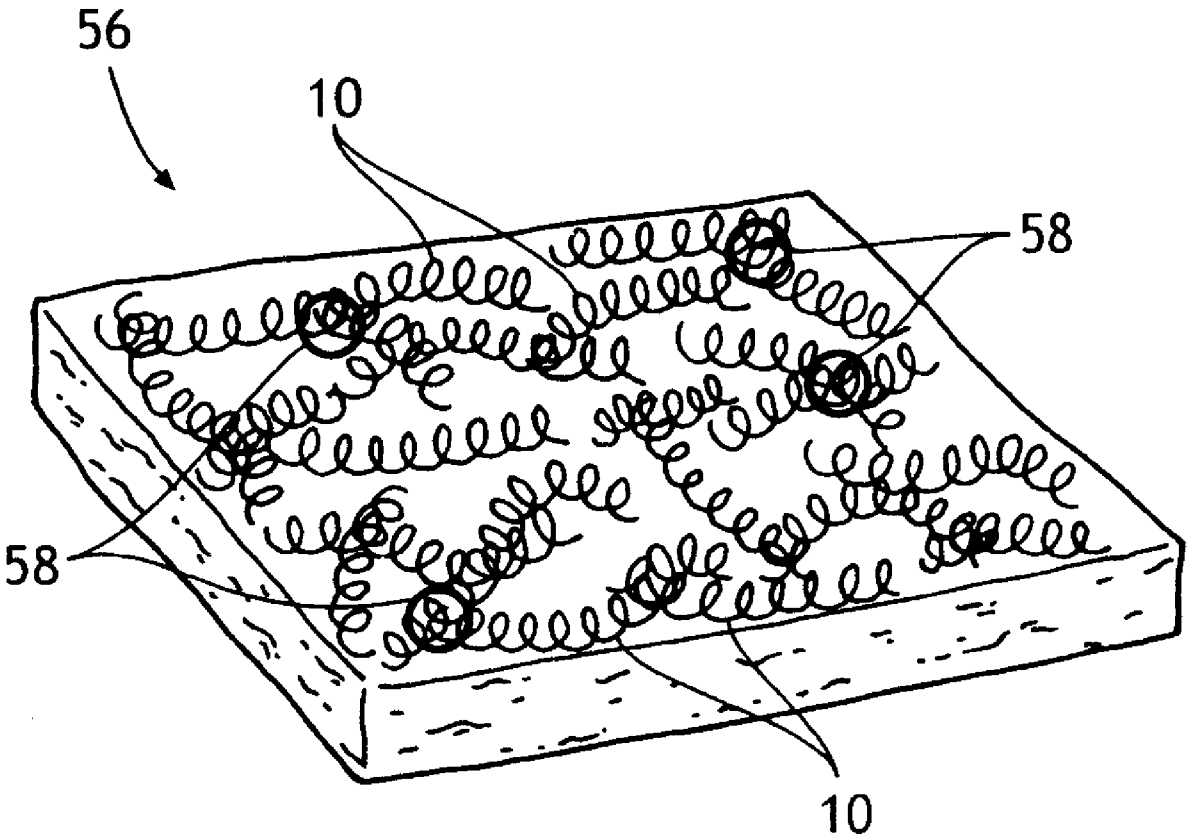
FIG. 13 is a perspective view of a web made from a plurality of a 3-dimensional fibers.

Referring now to FIG. 13, a web 56 is shown formed from a plurality of 3-dimensional fibers 10. The 3-dimensional fibers 10 can be randomly or uniformly arranged into the web 56. The web 56 can be an airlaid web, an air formed web, a coform web, a wet laid web, a spunbond web, etc. The web 56 can have a height dimension, a length dimension and a width dimension that can vary. The basis weight of the web 56 can also vary to meet one's particular needs. Each 3-dimensional fiber 10 has a first component and a second component. The first component is capable of being stretched, has a recovery percentage $R_1$, and a volume percent of about 30% to about 95%. The second component is capable of being stretched, has a recovery percentage $R_2$, and a volume percent of about 5% to about 70%. The recovery percentage $R_1$ is higher than the recovery percentage $R_2$. Desirably, the ratio $R_1/R_2$ is at least about 2. The first and second components are combined to form a linear fiber having an initial length that can be stretched at least 50%. The stretched fiber has the ability to retract to a length of from about 5% to about 90% of the stretched length to form a 3-dimensional fiber that exhibits elongation properties of at least 250% in at least one direction from the retracted length before the 3-dimensional fiber becomes linear. The individual 3-dimensional fibers 10 enable the web 56 to exhibit unique expansion properties so that the web 56 can hold or retain large quantities of fluid, such as urine. The 3-dimensional fibers also allow the web 56 to exhibit the desired stretchability and retraction properties.

The web 56 has a number of unique properties. The web 56 will be extensible in at least one direction, and desirably, in two directions. The web 56 will also exhibit controlled retraction, high loft and greater void volume than a web formed from a plurality of non-stretched and then relaxed fibers. Lastly, the web 56 will have a high degree of softness which is a very desirable property when the web material is utilized as a bodyside cover on a disposable absorbent article.

The web 56 can have an elongation of up to about 400% in at least one direction, the machine direction, the cross direction or it can have an elongation in both directions. Desirably, the web 56 will have an elongation of up to about 200% in the machine direction, the cross direction or in both directions. More desirably, the web 56 will have an elongation of up to about 100% in the machine direction, the cross direction or in both directions. The web 56 can be elongated and then will retract to approximately its original length when the elongation force is removed.

It should be noted that the extensible web 56 can be laminated to a stretchable material, an elastic film or elastic fibers to form a thin, non-absorbent material. This laminate material can be used as the bodyside cover or facing layer on a disposable absorbent article such as a diaper, training pant, incontinence garment, sanitary napkin, etc. This laminate material can also be used in health care products such as wound dressings, surgical gowns, gloves, etc.

A plurality of bonds 58 can be formed in the web 56 to secure at least some of the plurality of 3-dimensional fibers together. Desirably, each 3-dimensional fiber 10 will be bonded to at least one other 3-dimensional fiber 10. The bonds 58 will provide the web 56 with integrity. The bonds 58 can be randomly or uniformly spaced relative to one another. The bonds 58 can be formed by using heat, pressure or a combination of both heat and pressure. The bonds 58 can also be formed by ultrasonics, by latex bonding or by other means known to those skilled in the art. The size, shape, surface area and depth of each bond 58 can vary depending upon one's preferences. For example, the material from which the 3-dimensional fibers 10 are formed, as well as the thickness of the web 56, can influence the size, shape and type of bond utilized. It is also possible to use more than one kind of bond in the web 56, if desired.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations that fall within the spirit and scope of the appended claims.

We claim:

1. A 3-dimensional fiber comprising:

a) a first component capable of being stretched and having a recovery percentage $R_1$;

b) a second component capable of being stretched and having a recovery percentage $R_2$, wherein $R_1$ is higher than $R_2$, said first and second components being combined to form a linear fiber having an initial length that can be stretched at least 50%, and said stretched fiber having the ability to retract to a length of from about 5% to about 90% of said stretched length to form a 3-dimensional fiber that exhibits elongation properties of at least 250% in at least one direction from said retracted length before said fiber becomes linear.

2. The 3-dimensional fiber of claim 1 wherein said linear fiber has an inner core surrounded by an outer sheath.

3. The 3-dimensional fiber of claim 1 wherein said fiber is a helical coil.

4. The 3-dimensional fiber of claim 1 wherein said linear fiber is a synthetic fiber.

5. The 3-dimensional fiber of claim 1 wherein said retracted fiber can be elongated more than 100% of said retracted length.

6. The 3-dimensional fiber of claim 1 wherein said first and second components are physically connected by surface tension.

7. The 3-dimensional fiber of claim 1 wherein said first and second components are adhered to one another.

8. The 3-dimensional fiber of claim 1 wherein said first component is concentrically aligned with said second component.

9. The 3-dimensional fiber of claim 1 wherein said second component has a low elastic recovery.

10. A 3-dimensional fiber comprising:

a) a first component capable of being stretched and having a recovery percentage $R_1$;

b) a second component capable of being stretched and having a recovery percentage $R_2$, wherein the ratio $R_1/R_2$ is at least about 2, said first and second components being combined to form a linear fiber having an initial length that can be stretched at least 50%, and said stretched fiber having the ability to retract to a length of from about 5% to about 90% of said stretched length to form a 3-dimensional fiber that exhibits elongation properties of at least 250% in at least one direction from said retracted length before said fiber becomes linear.

11. The 3-dimensional fiber of claim 10 wherein said first component is polyester.

12. The 3-dimensional fiber of claim 10 wherein said first component is polylactic acid.

13. The 3-dimensional fiber of claim 10 wherein said second component is polyester.

14. The 3-dimensional fiber of claim 10 wherein said second component is polyether.

15. The 3-dimensional fiber of claim 10 wherein said second component is a polypropylene.

16. The 3-dimensional fiber of claim 10 wherein said stretched fiber acquires a non-linear configuration upon retraction.

17. A 3-dimensional fiber comprising:

a) a first component capable of being stretched and having a recovery percentage $R_1$, and said first component having a volume percent of about 30% to about 95%; and b) a second component capable of being stretched and having a recovery percentage $R_2$, and a volume percent of about 5% to about 70%, wherein the ratio $R_1/R_2$ is at least about 2, said first and second components being combined to form a linear fiber having an initial length that can be stretched at least 50%, and said stretched fiber having the ability to retract to a length of from about 5% to about 90% of said stretched length to form a 3-dimensional fiber that exhibits elongation properties of at least 250% in at least one direction from said retracted length before said fiber becomes linear.

18. The 3-dimensional fiber of claim 17 wherein said linear fiber has a circular cross-sectional configuration.

19. The 3-dimensional fiber of claim 18 wherein said first component is concentrically aligned with said second component.

20. The 3-dimensional fiber of claim 17 wherein said linear fiber has a circular cross-sectional configuration and each of said first and second components form a portion of said cross-sectional configuration.

21. The 3-dimensional fiber of claim 17 wherein said retracted fiber has a non-linear configuration.

22. The 3-dimensional fiber of claim 21 wherein said retracted fiber has a helical-coil configuration extending along at least a portion of said length.

23. The 3-dimensional fiber of claim 17 wherein said first and second components are chemically bonded to one another.

24. The 3-dimensional fiber of claim 17 wherein said linear fiber has a bilobal cross-section.

25. The 3-dimensional fiber of claim 17 wherein said linear fiber has a trilobal cross-section.

* * * * *